US007998034B1

(12) United States Patent
Cobo

(10) Patent No.: US 7,998,034 B1
(45) Date of Patent: Aug. 16, 2011

(54) RUNNER ARM TRAINING APPARATUS

(76) Inventor: Juan A. Cobo, Katy, TX (US)

( * ) Notice: Subject to any disclaimer, the term of this patent is extended or adjusted under 35 U.S.C. 154(b) by 0 days.

(21) Appl. No.: 12/949,359

(22) Filed: Nov. 18, 2010

(51) Int. Cl.
*A63B 71/00* (2006.01)
*A63B 21/02* (2006.01)

(52) U.S. Cl. ..... 482/74; 482/126

(58) Field of Classification Search ..... 482/121–122, 482/124–126, 148, 74, 51, 92
See application file for complete search history.

(56) References Cited

U.S. PATENT DOCUMENTS

| | | | | | |
|---|---|---|---|---|---|
| 4,019,734 | A * | 4/1977 | Lee et al. | 482/125 |
| 4,026,549 | A * | 5/1977 | Gunn | 482/124 |
| 4,090,706 | A * | 5/1978 | Reda | 482/122 |
| 4,245,840 | A * | 1/1981 | Van Housen | 482/124 |
| 4,733,862 | A * | 3/1988 | Miller | 482/126 |
| 4,852,874 | A * | 8/1989 | Sleichter et al. | 482/122 |
| 4,909,505 | A * | 3/1990 | Tee | 482/129 |
| 4,911,439 | A * | 3/1990 | Kuhl | 482/124 |
| 4,993,705 | A | 2/1991 | Tolle | |
| 5,137,272 | A * | 8/1992 | Wilkinson | 482/124 |
| 5,545,113 | A * | 8/1996 | Bobich | 482/125 |
| 5,571,064 | A * | 11/1996 | Holm | 482/129 |
| 5,681,248 | A * | 10/1997 | Vani | 482/126 |
| 5,683,336 | A | 11/1997 | Pape | |
| 6,244,998 | B1 * | 6/2001 | Hinds | 482/126 |
| 7,044,894 | B1 | 5/2006 | Smith | |
| 7,137,935 | B2 * | 11/2006 | Clarke et al. | 482/123 |
| 7,147,590 | B2 | 12/2006 | Toven | |
| 7,217,227 | B2 * | 5/2007 | Finn | 482/92 |
| 7,628,742 | B2 * | 12/2009 | Weaver | 482/125 |
| 7,744,512 | B2 * | 6/2010 | Clarke | 482/124 |
| 2003/0040408 | A1 | 2/2003 | Cooper, Sr. | |
| 2005/0085350 | A1 * | 4/2005 | Shen | 482/91 |
| 2005/0227833 | A1 * | 10/2005 | Wilkinson | 482/124 |

* cited by examiner

*Primary Examiner* — Steve R Crow
(74) *Attorney, Agent, or Firm* — Crossley Patent Law; Mark A. Crossley

(57) ABSTRACT

The runner arm training apparatus provides feedback to a user and help for a user in establishing a correct upper arm to lower arm, or elbow, angle. Typically, this angle is about 90 degrees. However, the apparatus may also be used to aid in preventing a 90-degree elbow bend, for perhaps a different athletic or rehabilitating pursuit.

11 Claims, 2 Drawing Sheets

RUNNER ARM TRAINING APPARATUS

BACKGROUND OF THE INVENTION

Training a runner, which is ubiquitous with training a plethora of athletes, involves teaching proper arm movement and arm carriage. For most activities that are at least partially running based, arms should be carried at about a 90-degree angle, regarding lower arm to upper arm positioning. This angle is continued with fore and aft arm swing to provide proper forward and rearward movement and to prevent lateral movements that detract from speed. This approximate 90 degree angle typically provides the highest speed of movement while counteracting lower body movement in equal-but-opposite force characteristics well understood in physics. Still in other events, the arms may need to be positioned with 90 degree bends but also limited in fore and aft movement and in potential movement across the body. Various devices have been provided that encourage such arm carriage and movement, yet none provide the simplicity of use and basic design inherent in the present apparatus.

FIELD OF THE INVENTION

The runner arm training apparatus relates to athletic training devices and more especially to an apparatus that trains proper arm carriage and swing in running.

SUMMARY OF THE INVENTION

The general purpose of the runner arm training apparatus, described subsequently in greater detail, is to provide a runner arm training apparatus which has many novel features that result in an improved runner arm training apparatus which is not anticipated, rendered obvious, suggested, or even implied by prior art, either alone or in combination thereof.

To attain this, the runner arm training apparatus provides feedback to a user for establishing a correct upper arm to lower arm, or elbow, angle. Typically, this angle is about 90 degrees. However, the apparatus may also be used to aid in preventing a 90-degree elbow bend, for perhaps a different athletic or rehabilitating pursuit. The apparatus may be effectively used to properly train a user in forward or backward running, without any wasted side-to-side motions. The apparatus can also be used to encourage a user to maintain 90-degree elbow bend in a host of other activities that are not directly running related. The center sleeve may ideally be provided in about 3 inches length or more to accommodate a user without any clothing or skin irritation to the user's arm from the band. Movement of arms at less than or greater than the 90-degree angle is felt by the user, and can therefore be counteracted in return to proper arm carriage and motion. Such feeling is verified by the fact that less than 90 degrees elbow bend and greater than 90-degree elbow bend results in the elasticity of each band to pull the elbow to greater deviation from the 90 degrees, thereby reinforcing to the user the fact that elbow angle is incorrect. As muscles are trained in the desired arm carriage and motions, a user also becomes more conditioned in same.

Importantly, the apparatus is provided in various band lengths so that any individual body size can be easily accommodated, without need for apparatus adjustment. Fitting, then, is simply choosing the correct and desired band length of apparatus for use. While second sleeves are offered in a variety of lengths, greater than 3 inches may be ideal for most applications. All sleeves may further comprise rigidity to better facilitate use and grip. Sleeves may also be pliable.

Sleeves may be rigid with cushioned exteriors. Ideally, the apparatus may be slideably provided and may be worn such that the center sleeve is slid to a position at about mid lower arm, with the first loop through the user's hand and trailed to above the user's wrist yet spaced downwardly from the user's elbow. Further adjustment may be provided by buckles that are adjustably positioned and clasped behind a user's elbows, as a part of each second loop.

With either a slideable or fixed center sleeve, the first loop importantly extends above a user's wrists so that no wrist irritation may occur. The looped crossbar may also be employed to control hand and arm movement. The looped crossbar may be flexible or rigid.

Thus has been broadly outlined the more important features of the improved runner arm training apparatus so that the detailed description thereof that follows may be better understood and in order that the present contribution to the art may be better appreciated.

An object of the runner arm training apparatus is to train an individual in proper arm carriage in running activities.

Another object of the runner arm training apparatus is to train an individual in proper arm swing in running activities.

A further object of the runner arm training apparatus is to negate any personalized adjustment requirements in using the apparatus.

An added object of the runner arm training apparatus is to provide instantaneous and constant feedback to the individual in arm use training.

Still another object of the runner arm training apparatus is to provide assistance for a user in maintaining proper arm carriage.

And, an object of the runner arm training apparatus is to provide an extremely lightweight apparatus.

Yet another object of the runner arm training apparatus is to negate any requirements for fastening the apparatus to a user.

Still another object of the runner arm training apparatus is to improve a user's running posture.

Another object of the runner arm training apparatus is to teach a runner energy conservation.

And, an object of the runner arm training apparatus is to be instantly applicable and removable.

These together with additional objects, features and advantages of the improved runner arm training apparatus will be readily apparent to those of ordinary skill in the art upon reading the following detailed description of presently preferred, but nonetheless illustrative, embodiments of the improved runner arm training apparatus when taken in conjunction with the accompanying drawings.

DETAILED DESCRIPTION OF THE DRAWINGS

Figure 1:
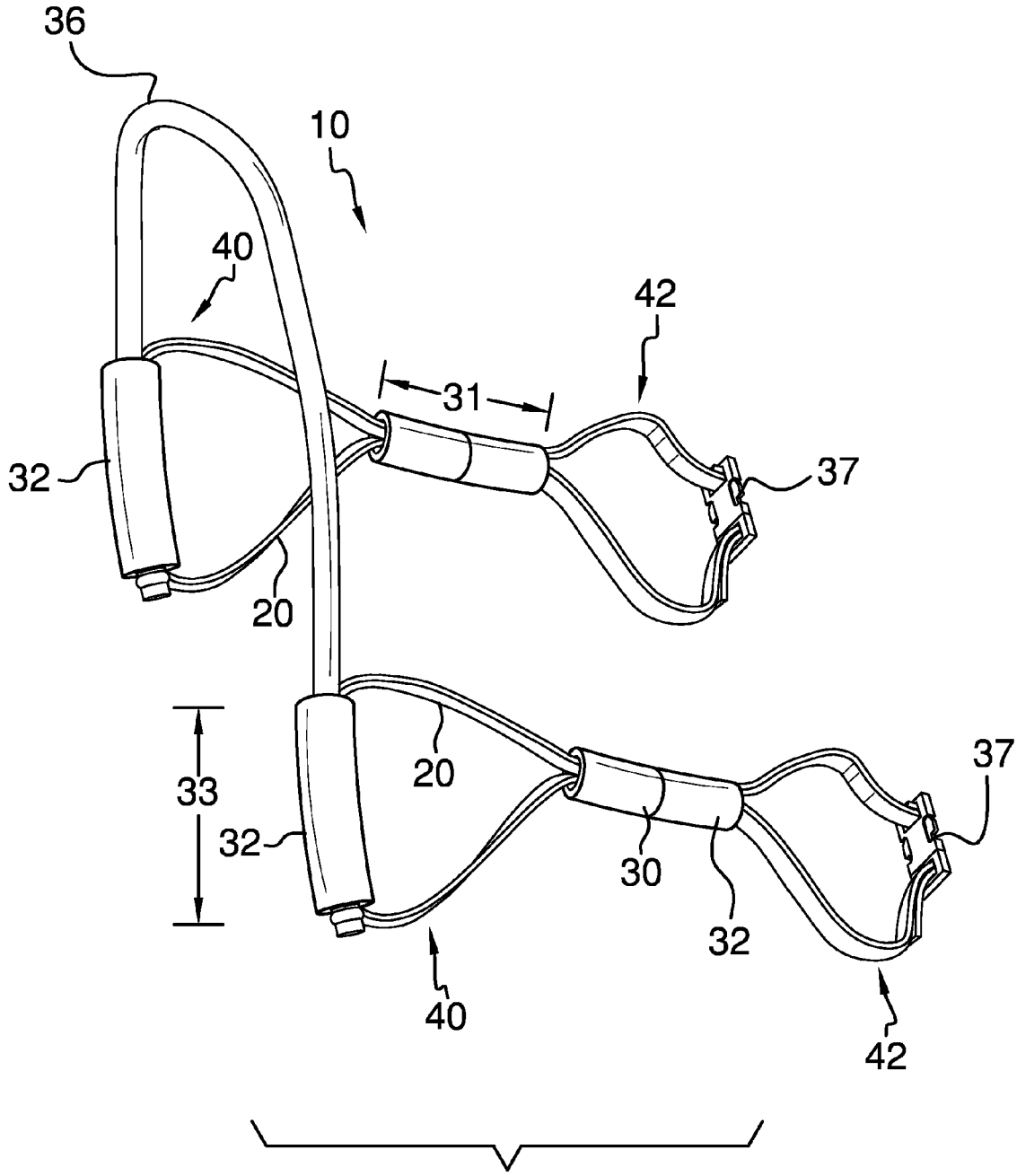
FIG. 1 is a perspective view.
Figure 2:
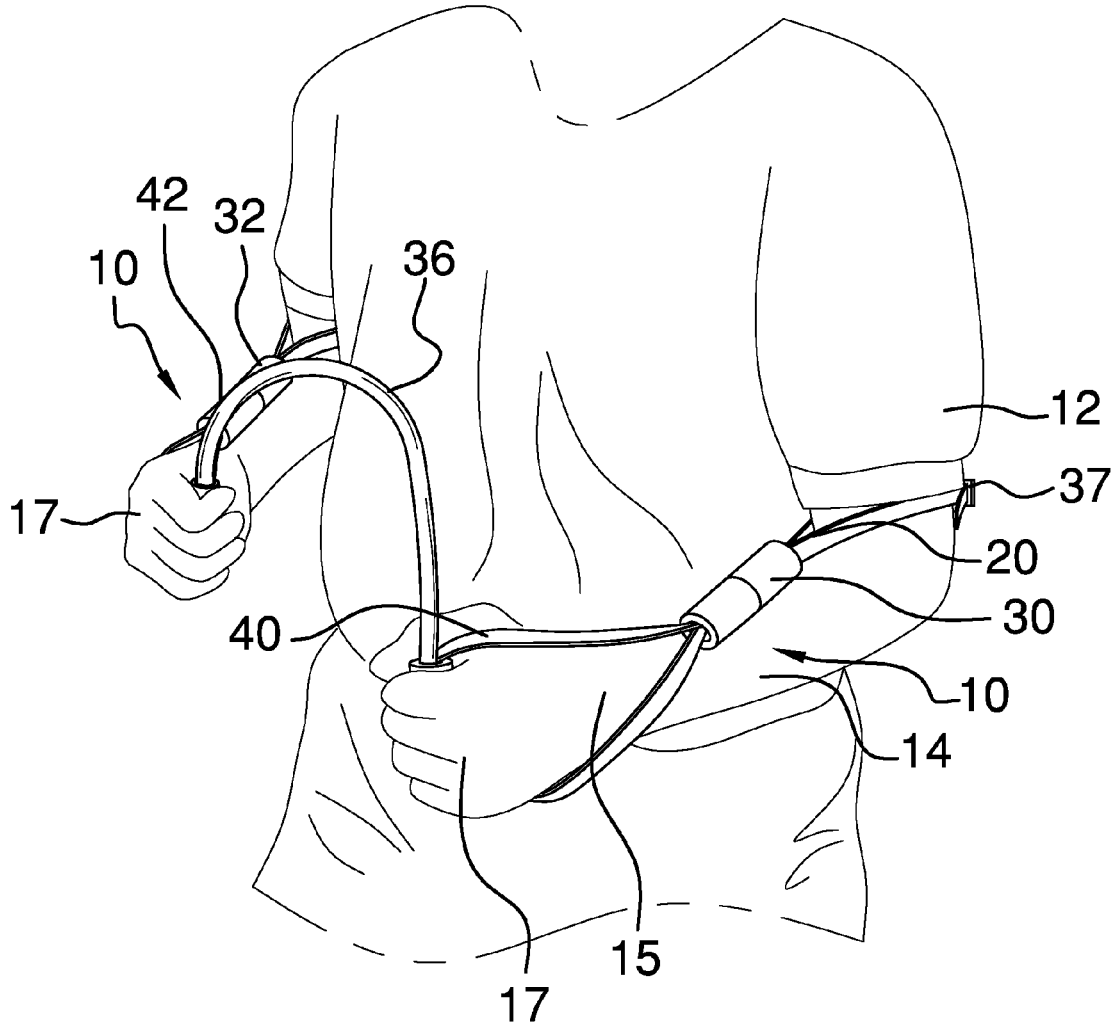
FIG. 2 is a perspective view of the apparatus in use.

With reference now to the drawings, and in particular FIGS. 1 through 2 thereof, the principles and concepts of the runner arm training apparatus generally designated by the reference number 10 will be described.

Referring to FIG. 1, the apparatus 10 partially comprises a pair of identical elasticized bands 20. Each band 20 further comprises a center sleeve 30 disposed slideably around the band 20. The center sleeve 30 has a center sleeve length 31 of at least about 3 inches. The center sleeve 30 thereby forms a pair of distally and oppositely disposed loops. The loops comprise the first loop 40 and a second loop 42.

A second sleeve 32 is laterally and slideably disposed around each first loop. Each second sleeve 32 has a second sleeve length 33 of at least 3 inches. Longer second sleeve lengths 33 are provided, also. A looped crossbar 36 connects the second sleeves 32 to maintain the arms in a parallel position and to keep the hands 17 closed while running.

Referring to FIG. 2, the apparatus is in use by positioning one of each of the bands 20 along one of each of the user's lower arms 14. A user then grasps one of each individual second sleeve 32 with one of each hand 17. A user then allows each first loop 40 to importantly pass over each user's wrist 15 and come together over an approximate center of each of the user's lower arms 14 by virtue of the center sleeves 30. This negates any irritation that might otherwise occur to the user. The second loop 42 is looped around the user's upper arm 12, typically proximal to the elbow. The second loop 42 second sleeve 32 is positioned around the user's upper arm 12 proximal to the elbow, with the adjustable buckle 37 used to adjustably fit each band 20. Any change of the angle of the user's lower arm 14 to upper arm 12 allows a user to feel the lower arm being influenced toward that angle change, as a 90 degree angle requires little force to maintain, and a lesser or greater angle sees the elasticity of the bands 20 influence undesirable lower arm 14 movements to increase the undesirable angle. The second sleeve 32 assists a user in keeping the user's hands 17 closed while running; however, an experienced user may remove the second sleeve 32 when the user is trained to keep the user's hands 17 closed while running.

What is claimed is:

1. A runner arm training apparatus comprising, in combination:

a pair of identical elasticized bands, each band further comprising:

a center sleeve disposed around each band, the sleeve having a center sleeve length of at least about 3 inches, the center sleeve thereby forming a pair of distally and oppositely disposed loops, comprising a first loop and a second loop; a looped crossbar connecting the second sleeves; whereby each first loop is grasped by the runner and each second loop engages the runner's upper arm during training;

a second sleeve laterally and slideably disposed around each first loop, each second sleeve having a second sleeve length of at least 3 inches;

an adjustable buckle disposed within each second loop.

2. The apparatus according to claim 1 wherein each center sleeve is further slideably disposed on each band.

3. The apparatus according to claim 1 wherein each center sleeve is further rigid.

4. The apparatus according to claim 2 wherein the center sleeve is further pliable.

5. The apparatus according to claim 3 wherein the center sleeve is further cushioned.

6. The apparatus according to claim 4 wherein the center sleeve is further cushioned.

7. The apparatus according to claim 1 wherein the second sleeve disposed around the second loop is further pliable.

8. The apparatus according to claim 2 wherein the second sleeve disposed around the second loop is further pliable.

9. A runner arm training apparatus comprising, in combination:

a pair of identical elasticized bands, each band further comprising:

a center sleeve disposed around the band, the sleeve having a center sleeve length of at least about 3 inches, the center sleeve thereby forming a pair of distally and oppositely disposed loops, comprising a first loop and a second loop;

a second sleeve laterally and slideably disposed around each first loop, each second sleeve having a second sleeve length of at least 3 inches;

a looped crossbar connecting the second sleeves;

an adjustable buckle disposed within each second loop; whereby each first loop is grasped by the runner and each second loop engages the runner's upper arm during training.

10. The apparatus according to claim 9 wherein the looped crossbar is further rigid.

11. The apparatus according to claim 9 wherein the looped crossbar is further flexible.

* * * * *